US008789216B2

(12) United States Patent
Sorensen et al.

(10) Patent No.: US 8,789,216 B2
(45) Date of Patent: Jul. 29, 2014

(54) SPA WITH WATERFALL

(71) Applicant: Sundance Spas, Inc., Chino Hills, CA (US)

(72) Inventors: Edwin C. Sorensen, Heathrow, FL (US); Charles S. Bonzagni, Ventura, CA (US); Bryan D. Huff, Point Richmond, CA (US); Randall K. Cooper, Canyon Lake, CA (US); Ian P. A. Scali, Ontario (CA); Erica A. Moir, Santa Ana, CA (US); Adrian Alfaro, Menifee, CA (US)

(73) Assignee: Sundance Spas, Inc., Chino, CA (US)

( * ) Notice: Subject to any disclaimer, the term of this patent is extended or adjusted under 35 U.S.C. 154(b) by 0 days.

(21) Appl. No.: 13/846,314

(22) Filed: Mar. 18, 2013

(65) Prior Publication Data

US 2013/0283517 A1 Oct. 31, 2013

Related U.S. Application Data

(63) Continuation of application No. 11/589,690, filed on Oct. 30, 2006, now Pat. No. 8,407,823.

(60) Provisional application No. 60/731,973, filed on Oct. 31, 2005.

(51) Int. Cl.
*A47K 3/00* (2006.01)

(52) U.S. Cl.
USPC ..... 4/541.1

(58) Field of Classification Search
USPC ..... 4/538–541.1, 546.1
See application file for complete search history.

(56) References Cited

U.S. PATENT DOCUMENTS

| | | | | |
|---|---|---|---|---|
| 35,410 | A | | 5/1862 | Bridges |
| 4,110,852 | A | | 9/1978 | Kline |
| 4,852,190 | A | * | 8/1989 | Jacuzzi et al. ..... 4/678 |
| 4,881,280 | A | | 11/1989 | Lesikar |
| 5,115,974 | A | | 5/1992 | Tobias et al. |
| 5,388,285 | A | | 2/1995 | Belniak |
| 5,415,221 | A | | 5/1995 | Zakryk |
| 5,474,102 | A | | 12/1995 | Lopez |
| 5,537,696 | A | | 7/1996 | Chartier |
| 5,605,622 | A | | 2/1997 | Ferraro |
| 5,753,112 | A | | 5/1998 | Barnes |
| 5,785,846 | A | | 7/1998 | Barnes et al. |
| 5,829,069 | A | | 11/1998 | Morgan et al. |
| 6,022,481 | A | | 2/2000 | Blake |
| D426,309 | S | | 6/2000 | Magray et al. |
| D429,528 | S | | 8/2000 | Magray et al. |
| 6,129,850 | A | | 10/2000 | Martin et al. |

(Continued)

*Primary Examiner* — Lori Baker
(74) *Attorney, Agent, or Firm* — The Webb Law Firm

(57) ABSTRACT

A vessel for containing liquid includes a floor perimetrically surrounded by a plurality of upwardly projecting walls; at least one exit port incorporated into at least one of the walls proximate to an upper edge of the at least one wall; and a liquid circulation pump apparatus. The liquid circulation pump apparatus includes a first conduit in fluid communication with the vessel; a circulation pump positioned downstream from and in fluid communication with the first conduit; a supply conduit positioned downstream from and in fluid communication with the circulation pump; and a diverter valve positioned downstream of the circulation pump and upstream of the supply conduit. The circulation pump is adapted to pump liquid from the vessel through the first conduit and deliver liquid through the supply conduit to the exit port. The diverter valve is adapted to change a rate of flow of liquid supplied to the exit port.

4 Claims, 11 Drawing Sheets

(56) References Cited

U.S. PATENT DOCUMENTS

| | | | | |
|---|---|---|---|---|
| 6,170,094 | B1 | 1/2001 | Weise et al. | |
| 6,395,167 | B1 | 5/2002 | Mattson, Jr. et al. | |
| 6,450,418 | B1 | 9/2002 | Simpson et al. | |
| 6,467,103 | B1 * | 10/2002 | Gardenier et al. | 4/541.1 |
| 6,470,508 | B2 * | 10/2002 | Turner | 4/541.1 |
| 6,510,227 | B2 | 1/2003 | Zambotti et al. | |
| 6,595,435 | B1 | 7/2003 | Cardenas | |
| 6,629,320 | B1 | 10/2003 | Gardenier et al. | |
| 6,763,532 | B2 * | 7/2004 | Gardenier et al. | 4/541.1 |
| 6,810,537 | B1 | 11/2004 | Barnes et al. | |
| 6,859,953 | B1 * | 3/2005 | Christensen | 4/541.1 |
| 6,968,581 | B2 * | 11/2005 | Christensen | 4/541.1 |
| 7,351,007 | B2 | 4/2008 | Ouwinga | |
| 7,600,273 | B2 * | 10/2009 | Gruenwald et al. | 4/541.1 |
| 8,028,354 | B2 * | 10/2011 | Gruenwald et al. | 4/622 |
| 2001/0018776 | A1 | 9/2001 | Koren et al. | |
| 2002/0053106 | A1 * | 5/2002 | Turner | 4/541.1 |
| 2003/0000010 | A1 | 1/2003 | Shimizu | |
| 2003/0070218 | A1 * | 4/2003 | Gardenier et al. | 4/541.1 |
| 2003/0154544 | A1 * | 8/2003 | Toye et al. | 4/541.1 |
| 2004/0062047 | A1 | 4/2004 | Camarota et al. | |
| 2004/0093666 | A1 | 5/2004 | Zars | |
| 2004/0140576 | A1 | 7/2004 | La Crosse | |
| 2004/0154094 | A1 * | 8/2004 | Ostrowski et al. | 4/541.1 |
| 2004/0160199 | A1 | 8/2004 | Morgan et al. | |
| 2004/0261168 | A1 | 12/2004 | Williams | |
| 2005/0036305 | A1 | 2/2005 | Kersey | |
| 2005/0044619 | A1 | 3/2005 | Mattson, Jr. et al. | |
| 2005/0066435 | A1 | 3/2005 | Barnes et al. | |
| 2005/0086733 | A1 | 4/2005 | Li et al. | |
| 2005/0128751 | A1 | 6/2005 | Roberge et al. | |
| 2005/0155144 | A1 | 7/2005 | McDonald et al. | |
| 2005/0199289 | A1 | 9/2005 | McDonald et al. | |
| 2005/0204463 | A1 | 9/2005 | Ryan | |
| 2005/0223490 | A1 | 10/2005 | Kunkel | |
| 2005/0235407 | A1 | 10/2005 | Kunkel | |
| 2005/0236998 | A1 | 10/2005 | Mueller et al. | |
| 2005/0248299 | A1 | 11/2005 | Chemel et al. | |
| 2005/0248944 | A1 | 11/2005 | Sloan | |
| 2005/0268393 | A1 * | 12/2005 | Bergstrom | 4/541.1 |
| 2006/0021127 | A1 | 2/2006 | Li et al. | |

* cited by examiner

SPA WITH WATERFALL

CROSS REFERENCE TO RELATED APPLICATIONS

This application is a continuation application of U.S. patent application Ser. No. 11/589,690, filed Oct. 30, 2006, entitled "Spa with Waterfall", which claims the benefit of U.S. Provisional Patent Application No. 60/731,973, filed Oct. 31, 2005, entitled "Improved Spa", which are hereby incorporated by reference in their entirety.

BACKGROUND OF THE INVENTION

1. Field of the Invention

This invention incorporates various fields of technology and is specifically directed to various preferred and modified embodiments that enable an improved waterfall capability and pumping system and an illuminated and submerged indicia display, which are in one variation directed to applications that can include, for purposes of example, recreational and therapeutic water reservoirs and/or basins.

2. Description of Related Art

Such recreational and therapeutic water reservoirs or basins will be primarily referred to herein as spas and, among other often used nomenclature, can also be referred to as pools, bathtubs, baths, hot tubs, roman tubs, whirlpools, and hydrotherapeutic tubs. Owners and users of such spas have long enjoyed various forms of aesthetically pleasing lighting and water features that are incorporated therein. Various types of lighting and water features have included, for purposes of example but not for purposes of limitation, above-water and submerged lighting and water hydrotherapy jets and water sheet supply devices. For applications above the surface of the water, those skilled in the art also refer to water sheet supply devices as waterfalls.

While such features have often included many forms of lighting, one of the most common variations includes lighting that is mounted on and in the floors and walls of the spa. Of the many particular water features that can be incorporated, many have found it desirable to incorporate one or more water sheeting or waterfall devices into the spa.

One more recent attempt to fabricate a waterfall amenity into a spa is illustrated in U.S. Pat. No. 6,595,435 to Cardenas, which is restricted to a pop-up, telescoping waterfall apparatus that is mounted into a side wall portion of the spa. When the '435 waterfall apparatus is pressurized with water, it is elevated from a retracted position to create the waterfall feature. Another previous attempt to incorporate a waterfall apparatus into a spa is explained in U.S. Pat. No. 6,450,418 to Simpson et al., which is limited to a complex arrangement of a manifold having internal baffles and adapted with interchangeable outlet caps.

Another contemplated waterfall approach is explained in U.S. Pat. No. 6,170,094 to Weise et al. Like other attempts, the '094 waterfall apparatus requires an assembly of detailed components that must be mounted into a wall of a spa. Similar complex assemblies are required in yet more previous devices, such as that described in U.S. Pat. No. 5,537,696 to Chartier, which must include a large manifold chamber to create the waterfall. Each of these disclosures is incorporated by reference in their entirety as though fully set forth in the instant written description of the invention.

As those having skill in the relevant arts may be able to appreciate after a cursory review of the aforementioned waterfall devices, such devices can be complex to fabricate and incorporate into a spa. Moreover, many such previous attempts at waterfall configurations are prone to becoming fouled and inoperable, and can become difficult to maintain and use by spa owners and users. Also, costs of operation can be significant in that the operation of the spa and the proposed waterfall consumes a significant amount of energy to drive the hydrotherapeutic water jet pumps and jet pump water circuits described in the prior art.

Further, previous waterfall devices are mostly adapted to operate using high powered pump circuits, which can further increase the cost of manufacture, and the expenses of operation and maintenance. Other concerns with previous waterfall devices are also directed to the need to create more aesthetically appealing acoustical and visual waterfall experiences for owners and users of such spas.

Many such spa configurations, including those described in the prior art of record here, have been adapted by those experienced in the related arts to include various types of lights that can be mounted in and on floors, walls, side rails, and nearly anywhere on or about the spas and features incorporated therein. Despite such long use in the industry, manufacturers continue to seek new lighting techniques and devices that can further meet the needs for enhanced, more pleasing, and more commercially innovative lighting devices.

While users and consumers of spas and similar recreational and therapeutic water devices continue to desire waterfall features, manufacturers are therefore confronted with the need to create less complicated waterfall designs that cost less to manufacture, and which are preferably easier for users and owners to maintain and which consume less energy to operate.

SUMMARY OF THE INVENTION

The present invention is directed to a vessel for containing a liquid. The vessel includes a floor perimetrically surrounded by a plurality of upwardly projecting walls where the floor and walls define a liquid defining area; at least one exit port incorporated into at least one of the upwardly projecting walls proximate to an upper edge of the at least one wall; and a liquid circulation pump apparatus. The liquid circulation pump apparatus includes a first conduit in fluid communication with the liquid containing area of the vessel; a circulation pump positioned downstream from and in fluid communication with the first conduit; a supply conduit positioned downstream from and in fluid communication with the circulation pump; and a diverter valve positioned downstream of the circulation pump and upstream of the supply conduit and in fluid communication with the circulation pump and the supply conduit. The circulation pump is adapted to pump liquid from the liquid containing area through the first conduit and deliver liquid through the supply conduit to the at least one exit port. The diverter valve is adapted to change a rate of flow of liquid supplied to the at least one exit port.

The vessel may be any suitable vessel such as a spa. The at least one exit port may be a discharge orifice for a waterfall. The liquid circulation pump apparatus may further include a discharge line in fluid communication with the diverter valve and a discharge port adapted to be positioned on one of the floor and the plurality of upwardly projecting walls. The diverter valve may be an adjustable diverter valve. The diverter valve may be adjusted such that when the diverter valve is in a first position all of the liquid passing through the liquid circulation pump apparatus passes through the at least one exit port, when the diverter valve is in a second position none of the liquid passing through the liquid circulation apparatus passes through the at least one exit port and all of the liquid passes through the discharge line and the discharge port, and when the diverter valve is positioned in a third position, a portion of the liquid passing through the liquid circulation pump apparatus passes through the at least one exit port and a portion passes through the discharge line and the discharge port. The diverter valve may include an actuator knob positioned on an upper edge of one of the plurality of upwardly projecting walls thereby allowing a user to adjust the rate of flow of liquid supplied to the at least one exit port.

The at least one exit port may include a first orifice positioned perpendicularly to a first spillway ledge and a second orifice positioned perpendicularly to a second spillway ledge, the first and second orifices separated by a separator ridge. The first spillway ledge and second spillway ledge may define a waterfall.

The vessel may further include a primary pump for providing pressurized liquid through a plurality of jets positioned on at least one of the floor or a wall of the vessel. The primary pump may be distinct and separate from the circulation pump. The first conduit may be an aspiration conduit. When the circulation pump passes liquid to the aspiration conduit, the liquid from the vessel is aspirated.

The vessel may further include an illuminated indicia display positioned below a liquid level of a body of liquid in the vessel on at least one of the floor and the plurality of sides. The illuminated indicia display may include at least one light source and a translucent lens positioned over the at least one light source. The at least one light source may be a light emitting diode, a light bulb, a fiber optic lighting device or any combination thereof.

The present invention is also directed to a method of circulating liquid in a vessel for forming a stream of liquid within the vessel. The method includes the steps of: providing a circulation pump in fluid communication with a body of liquid in the vessel; delivering pressurized fluid from the circulation pump to an adjustable diverter valve that is in fluid communication with the circulation pump; adjusting the diverter valve to change a rate of flow of liquid delivered to a supply conduit; and delivering liquid from the diverter valve through the supply conduit to the at least one exit port.

The vessel may be a spa, and the at least one exit port may be a waterfall. The method may further include the step of providing a discharge line in fluid communication with the diverter valve and a discharge port positioned within the vessel. The discharge line may divert pressurized liquid from the circulation pump to the vessel via the discharge port when the diverter valve is adjusted to divert at least a portion of the liquid from the at least one exit port. The diverter valve may include an actuator knob positioned on an upper edge of a wall of the vessel thereby allowing a user to adjust the rate of flow of liquid supplied to the at least one exit port.

The present invention is further directed to a liquid circulation pump apparatus. The apparatus includes a first conduit in fluid communication with a liquid-containing area of a vessel; a circulation pump positioned downstream from the first conduit and in fluid communication with the first conduit; a supply conduit positioned downstream from the circulation pump and in fluid communication with the circulation pump; and a diverter valve positioned downstream of the circulation pump and upstream of the supply conduit and in fluid communication with the circulation pump and the supply conduit. The circulation pump is adapted to pump liquid from the liquid-containing area through the first conduit and delivers pressurized liquid through the supply conduit to the at least one exit port. The diverter valve is adapted to change a rate of flow of liquid supplied to the at least one exit port.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE PRESENT INVENTION

Figure 1:
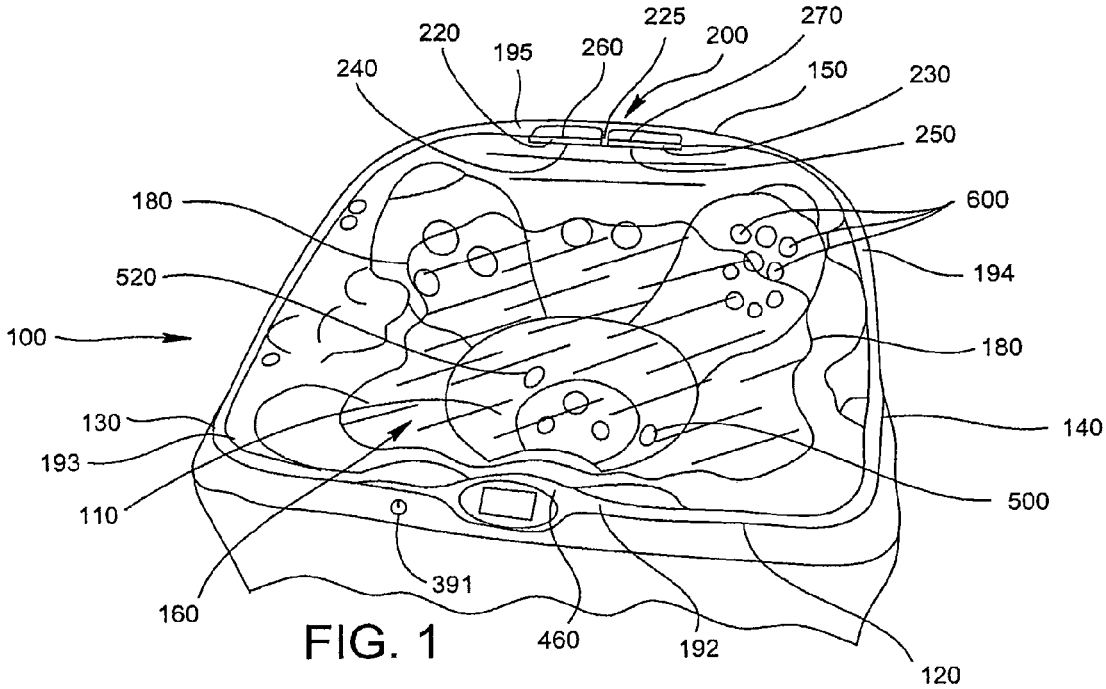
FIG. 1 is an elevated, isometric front view of one possible embodiment of a spa that incorporates an improved waterfall apparatus according to the principles of the instant invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

In a wide range of possible embodiments and modifications and variations thereof, the inventive waterfall device and illuminated indicia display apparatus according to the principles of the instant invention are adapted for use with any type of recreational and therapeutic liquid vessels. As explained elsewhere herein, the contemplated vessel is primarily referred to in this description of the invention as "spas". However, this is not to be construed as limiting the present invention as the use of the waterfall device; and illuminated indicia display apparatus of the present invention in other liquid vessels has been envisioned. For instance, the waterfall device and illuminated indicia of the present invention may be utilized in liquid vessels such as, but not limited to, bath tubs, swimming pools and the like.

With reference now to the various figures, views, and illustrations, and specifically with reference to FIGS. 1 through 7, a vessel such as a spa, generally denoted by reference numeral 100, includes a floor or bottom 110, which is perimetrically surrounded by an upwardly projecting wall or walls 120, 130, 140, 150. Together, the bottom 110 and wall or walls 120, 130, 140, 150 define a basin or reservoir 160 that is sized to contain a body of water 170 to be filled to a predetermined level 180 below respective upper edges 192, 193, 194, 195 of the wall or walls 120, 130, 140, 150.

An exit port, such as a waterfall device, generally denoted by reference numeral 200, is incorporated in a unitary fashion into one or more of the walls 120, 130, 140, 150 proximate to the upper edges 192, 193, 194, 195. Blended rim portions "A" and "B" connect edges 193 and 194 to edge 195. Even more preferably, at least one such waterfall device 200 is integrally molded into one or more locations, such as, for purposes of illustration without limitation, in the rear wall 150, which is modified and formed integrally as at least one raised rim portion 210. Variations of the raised rim portion 210 should be evident to those skilled in the art and can preferably be formed as an entire upper edge 195 or as just a selected portion 210 or section of the upper edges of the upwardly projecting wall 150 and/or walls 120, 130, 140, 150. Notably, the raised rim portion 210 is raised to a height "H" from edge 194 and/or edges 192, 193. Further, raised rim portion 210 is dimensionally arranged and sized to project up from the uppermost edges of the surrounding, perimetrical walls 120, 130, 140, 150, or other walls, which may be adapted to include the waterfall device 200.

As shown for purposes of illustration here, the raised rim portion 210 is thereby integrally formed about the upper edge 195 and in the wall 150 to be above the predetermined water level 180 and height "H" above edges 192, 193, and 194 to create a significant distance for falling water to drop before contacting the predetermined water level 180. The waterfall device 200 also includes at least one, but optionally one or more, spillway ledge(s) 220, 230. The spillway ledges 220, 230 can incorporate an optional separator ridge 225 and will generally extend inwardly towards the reservoir 160 and terminate in respective spillway ledge edges 240, 250 that are thus positioned above the surface of the predetermined water level 180.

Figure 14:
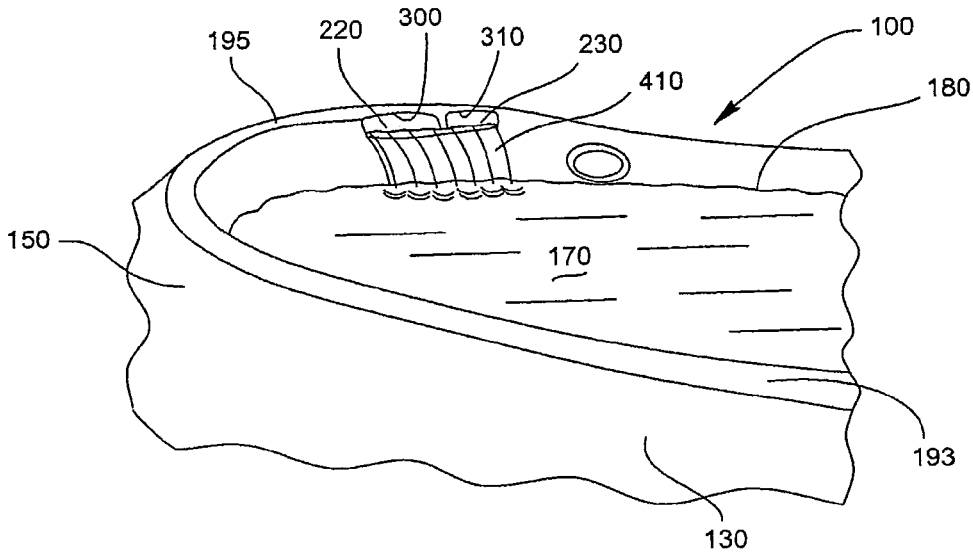
FIGS. 14 and 15 show the rim/waterfall arrangement made in accordance with the instant invention.
Figure 15:
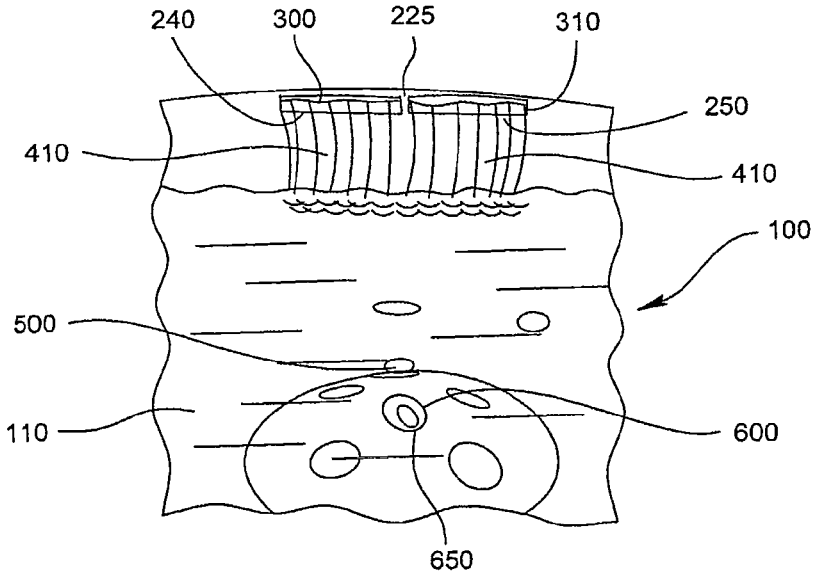

The spillway ledges 220, 230 also extend into a raised rim portion 210 of the upper edge 195 of the wall 150, thus extending to outside edges 260, 270, which are formed in a corner (collinear with outside edges 260, 270) where the ledges 220, 230 intersect respective back walls 280, 290 of the waterfall device 200. Further, at least one respective waterfall supply orifice 300, 310 is formed in, on, and/or adjacent to the outside edges 260, 270 of the spillway ledges 220, 230. While many equally desirable locations and configurations of the supply orifices 300, 310 are contemplated, in one variation of the preferred embodiments, the water supply orifices 300, 310 are defined to be horizontally extending slots (FIGS. 4, 5, and 7) that span a portion of, or the entire width of, the respective spillway ledges 220, 230 and collinear with the described corners or outside edges 260, 270. FIGS. 14 and 15 show other views of the waterfall/ledge arrangement made in accordance with the present invention, which can be further adapted with lights about, proximate to, and/or within the ledges 220, 230, and jets 600.

Figure 7:
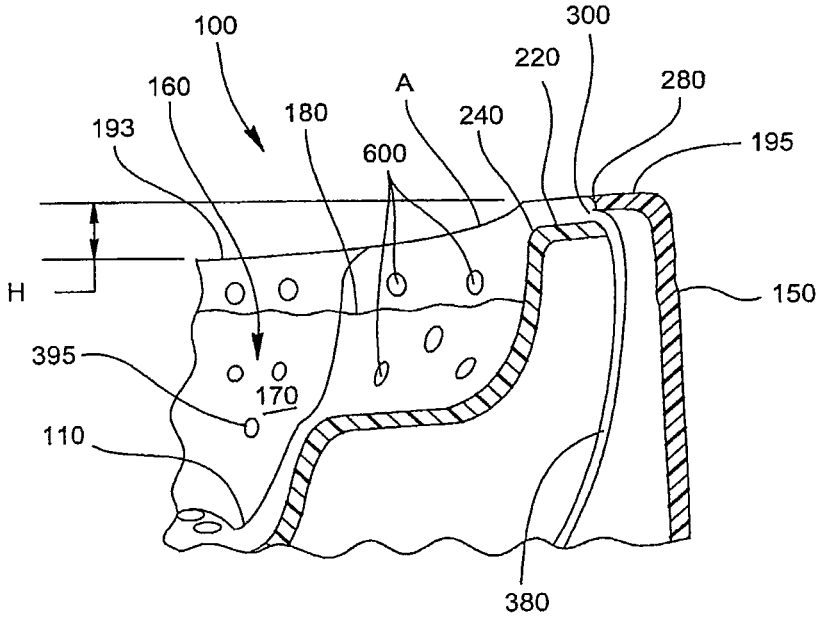
FIG. 7 is a section view taken about section line 7-7 of FIG. 5 of the inventive waterfall apparatus of FIGS. 5 and 6.
Figure 8:
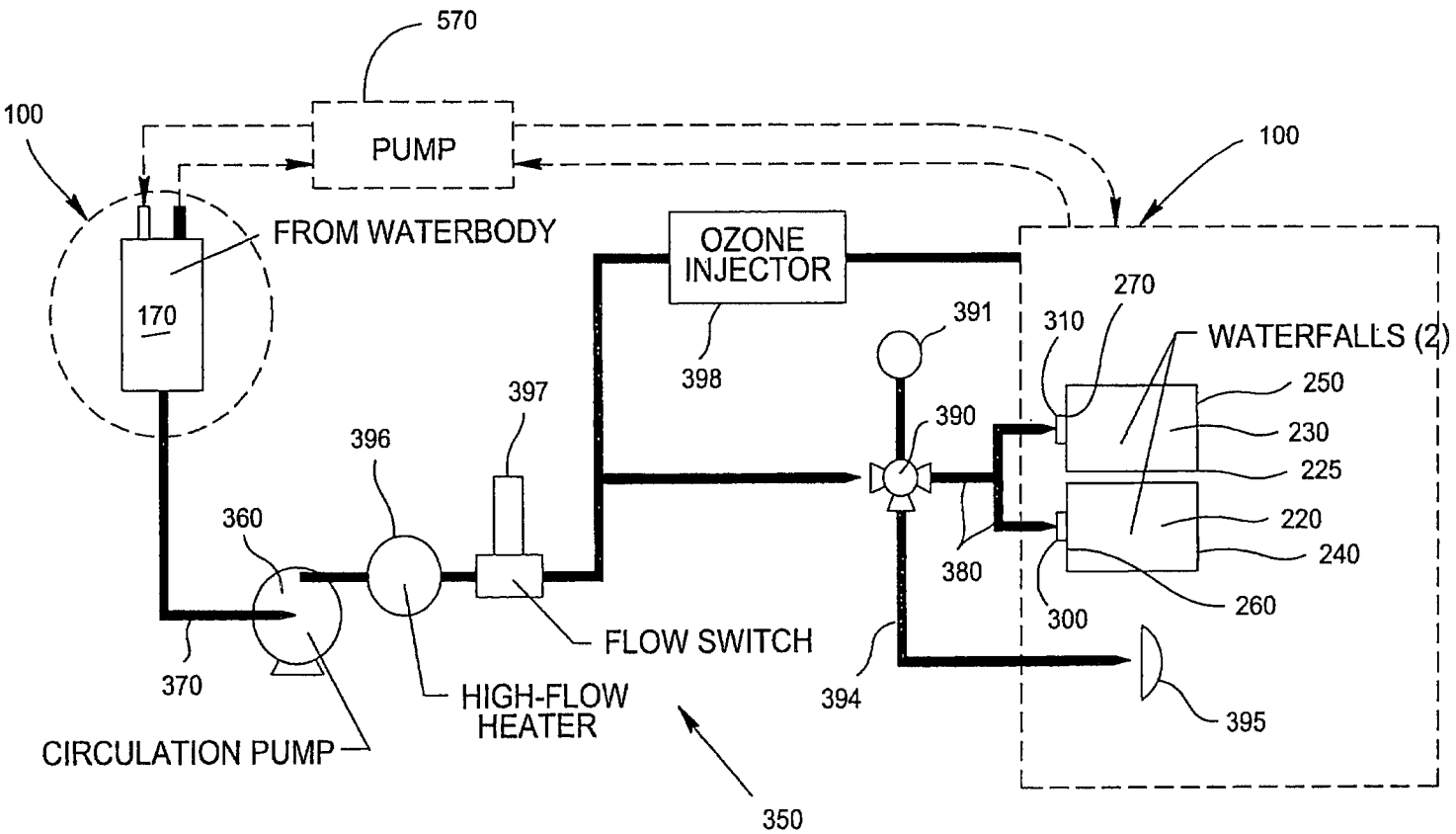
FIG. 8 is a diagrammatic view of an inventive circulation pump circuit contemplated for use with the devices of the invention.

With continued reference to the many illustrations and figures, and now also with reference to FIGS. 7 and 8, the instant invention also contemplates an improved liquid circulation pump apparatus 350 (FIG. 8) adapted to supply pressurized water to the waterfall device 200. The liquid circulation pump apparatus 350 includes an aspiration conduit 370 adapted to be in fluid communication with the reservoir 160 of the spa 100, a circulation pump 360 in fluid communication with and positioned downstream of the aspiration conduit 370, a supply conduit 380 in fluid communication with and positioned downstream of the circulation pump 360 for delivering pressurized water from the circulation pump 360 to the orifices 300, 310 (FIGS. 4, 5, 7, 14 and 15) of the waterfall device 200, and a diverter valve 390 positioned downstream of the circulation pump 360 and upstream of the supply conduit 380 and in fluid communication with the circulation pump 360 and the supply conduit 380. The circulation pump 360 is adapted to pump liquid from the reservoir 160 through the aspiration conduit 370 and deliver liquid through the supply conduit 380 to the orifices 300, 310 of the waterfall device 200. The diverter valve 390 is adapted to change a rate of flow of liquid supplied to the orifices 300, 310 of the waterfall device 200. The liquid circulation pump apparatus 350 may further include a discharge conduit 394 and a discharge port 395 to divert a portion of the water directed to the waterfall back into the water body 170 at discharge port 395 as indicated in FIG. 7. The discharge conduit 394 and discharge port 395 can function to bypass pressurized water from the circulation pump 360 when the diverter valve 390 is actuated in a less than fully open position, which is useful for lower flow rate configurations of the waterfall device 200.

Figure 9A:
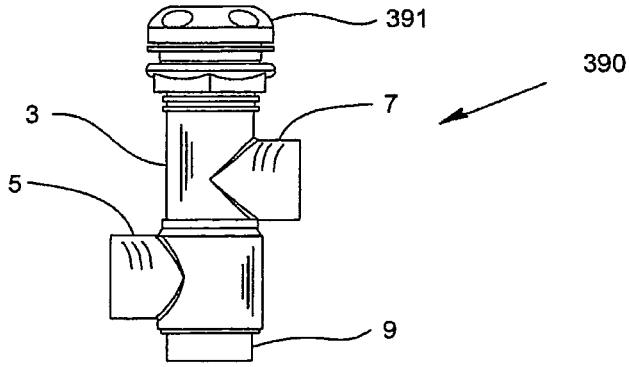
FIGS. 9A and 9B are a side view and cross-sectional view of a diverter valve for use with the inventive circulation pump circuit of FIG. 8.
Figure 9B:
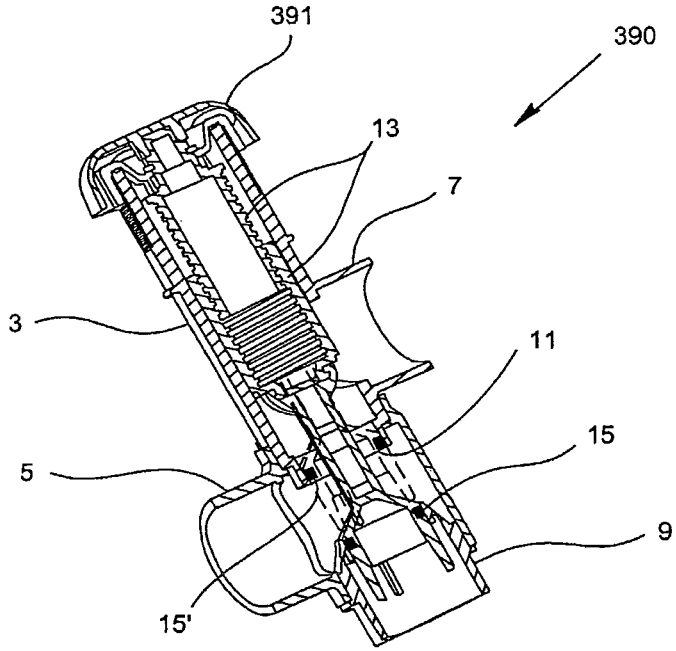

The diverter valve 390 may be any suitable three-way, manually operated diverter valve which diverts water between the waterfall device and the discharge port and also controls water flow through the waterfall device. For instance, and without limitation, the diverter valve 390 may be configured as illustrated in FIGS. 9A and 9B. The diverter valve 390 includes a hollow valve body 3 with an inlet port 5, a first outlet port 7 and a second outlet port 9. The inlet port 5 is in fluid communication with the circulation pump 360, the first outlet port 7 is in fluid communication with supply conduit 380 and the second outlet port 9 is in fluid communication with the discharge conduit 394. The diverter valve 390 further includes a plunger 11 disposed within the valve body 3. The plunger 11 is operatively coupled to a plunger actuation mechanism 13, which is in turn coupled to an actuator knob 391. The actuator knob 391 may be positioned on an upper edge 192, 193, 194, 195 of one of the plurality of upwardly projecting walls 120, 130, 140, 150 thereby allowing a user to adjust the rate of flow of water supplied to the orifices 300, 310 of the waterfall device 200. The plunger 11 may further include an o-ring 15 adapted to provide a fluid-tight seal between the plunger 11 and the second outlet port 9 when the actuator knob 391 is in a first position and a fluid-tight seal between the plunger 11 and the first outlet port 7 when the actuator knob 391 is in a second position.

The actuator knob 391 may be adjustable to an infinite number of positions or may have a predetermined number of positions. For example, the actuator knob 391 may have three positions and function as follows. The diverter valve 390 may be adjusted by the actuator knob 391 such that when the actuator knob 391 is in a first position the plunger seals the second outlet port 9 thereby forcing all of the liquid passing through the liquid circulation pump apparatus 350 to pass through the first outlet port 7 to the supply conduit 380 and out the orifices 300, 310 of the waterfall device 200. If a user adjusts the actuator knob 391 to be in a second position, the plunger actuation mechanism 13 forces the plunger 11 into a second position (shown in phantom) where a fluid-tight seal is created between the o-ring 15 (designated as 15' in this position) of the plunger 11 and the first outlet port 7. In this configuration, none of the liquid passing through the liquid circulation apparatus 350 passes through the first outlet port 7 to the supply conduit 380 and out the orifices 300, 310 of the waterfall device 200 and all of the liquid passes through the second outlet port 9 to the discharge conduit 394 and the discharge port 395. When a user positions actuator knob 391 in a third position, the plunger actuation mechanism 13 forces the plunger 11 into a position where neither the first outlet port 7 nor the second outlet port 9 is sealed. In this configuration, a portion of the liquid passing through the liquid circulation pump apparatus 350 passes through the first outlet port 7 to the supply conduit 380 and out the orifices 300, 310 of the waterfall device 200 and a portion passes through the second outlet port 9 to the discharge conduit 394 and the discharge port 395. However, this example is not to be construed as limiting the present invention, as an actuator knob with any suitable number of positions has been envisioned.

The liquid circulation pump apparatus 350 also includes a high-flow heater 396 and a flow switch 397 positioned upstream from diverter valve 390 and downstream from the circulation pump 360. The high-flow heater 396 heats the pressurized fluid from the circulation pump 360 thereby allowing heated water to be provided to the orifices 300, 310 of the waterfall device 200. The flow switch 397 is provided to sense water flow and provide an electrical interlock which shuts down the spa water heater upon loss of flow through the circulation system. An ozone injector 398 is also provided in fluid communication with the flow switch 397 and the spa 100. The ozone injector 398 supplies ozone to the spa 100 for disinfection and cleaning purposes.

Prior art spa arrangements utilize one pump for both circulation and for other features. One of the advantages of the present invention is that it includes two pumps: one pump for jets and circulation 570 and one circulation pump 360 (FIG. 8) for the waterfall. As a result of such an arrangement, the spa 100 of the present invention utilizes substantially less electricity than prior art spa arrangements.

Figure 10:
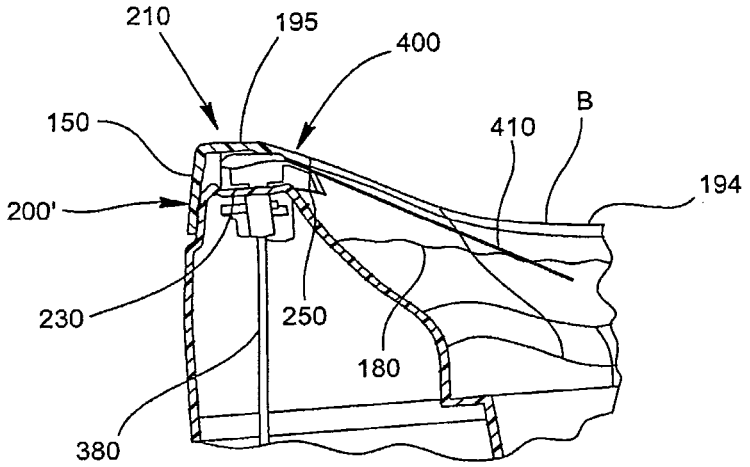
FIG. 10 is a cut-away view of the spa of the preceding figures and showing another modification to the preceding devices contemplated by the principles of the invention.

In yet further variations to any of the preceding embodiments of the invention, those having requisite knowledge of spa technology may also be able to further comprehend modifications of the instant invention and can further incorporate additional components to change the aesthetic aspects of the waterfall device 200. With reference now also to FIG. 10, the waterfall spillway ledges 220, 230 of waterfall device 200' can be adapted to mount various types of waterfall components, such as waterfall pitch enhancing nozzle assembly 400. This type of nozzle assembly 400 can optionally project various types of sheets 410 into the water body 170 and can be incorporated for operation independent of, along with, and in combination with the elements of any of the preceding embodiments already described.

Figure 11:
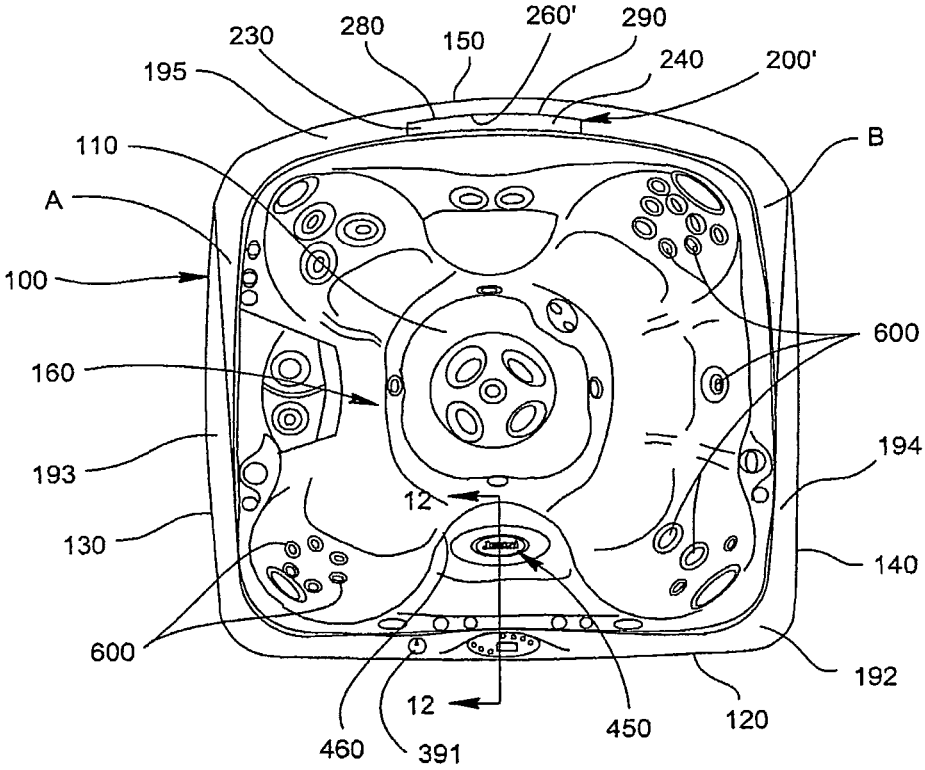
FIG. 11 is a top plan view of the spa of the preceding figures and illustrating, among other features, an inventive illuminated indicia display.

Any of the preferred and modified embodiments of the inventive spas can be further adapted with variations that can include aesthetically desirable lighting elements and devices. With reference now also specifically to FIGS. 2, 3, 11, 12 and 13, it can be understood that any of the embodiments of the invention can incorporate one or more illuminated indicia displays 450, which is shown in an arrangement that is submerged below the predetermined water level 180. The new illuminated indicia display 450 can be positioned and mounted in nearly any desired location about the contemplated spa 100. For purposes of illustration without limitation, the illuminated indicia display 450 is depicted here as being mounted in a shelf 460 submerged below the predetermined water level 180 that is integrally formed in the wall 120. However, the illuminated indicia display 450 can be mounted in walls 120, 130, 140, 150, the floor 110, or in any other submerged or other location in and about the spa 100. Also, FIG. 11 illustrates an alternative configuration of the contemplated device 200', which here is configured as an exemplary single spillway ledge 260' variation of the preceding embodiments.

Figure 12:
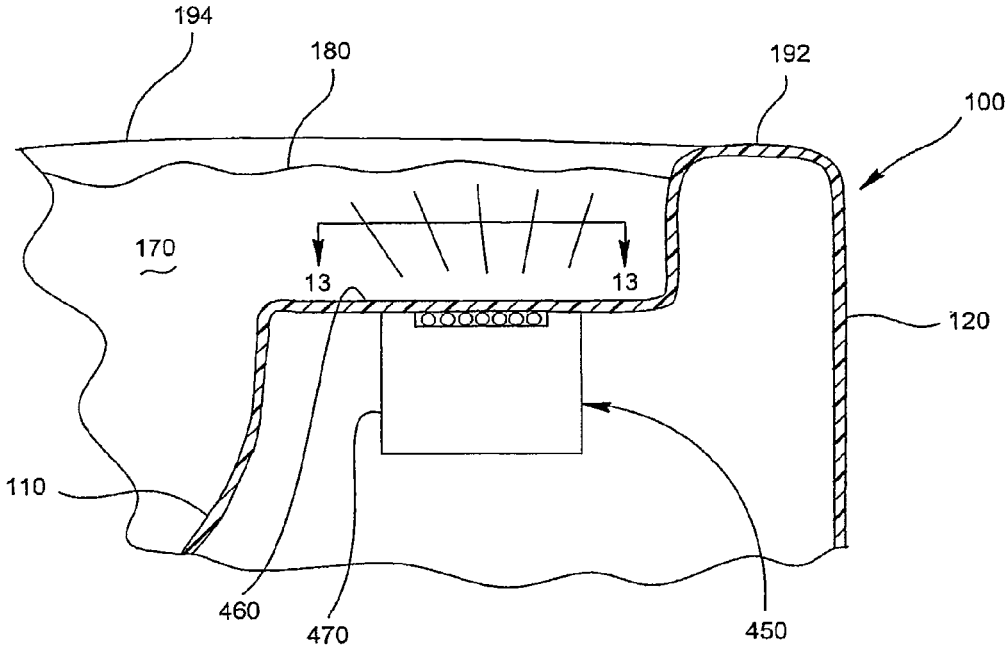
FIG. 12 is a section view taken about section line 12-12 in FIG. 11.
Figure 13:
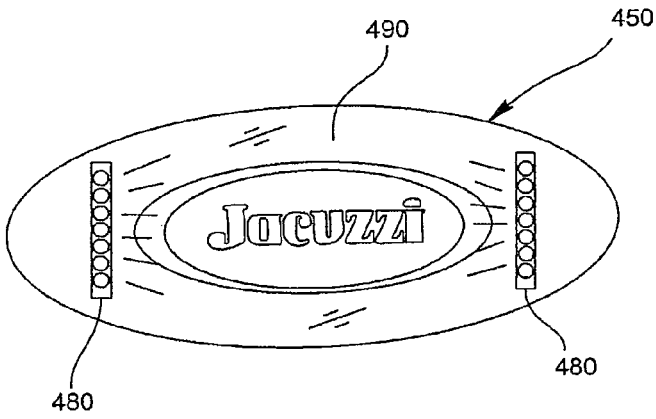
FIG. 13 is a partial top view taken about section line 13-13 of FIG. 12.

With reference to FIGS. 12 and 13, illumination indicia display 450, in its typical configuration, incorporates at least one light source 470, which can be in the form of light emitting diode devices, light bulbs, fiber optic devices, and any other preferred light source in use by those working in the field of art. As shown in these illustrative modifications to the preferred embodiments of the invention, the indicia display 450 is positioned to project light from a location below the predetermined water level 180, or from a submerged location, and towards the surface of the predetermined water level 180. Hence, the light includes a transparent or translucent lens 490 with a light source 470 positioned on an underside thereof. The display 450 is coupled to the spa body and includes a water tight seal therebetween. The illuminated logo provides product name recognition from under water during operation and a pleasing appearance.

Figure 2:
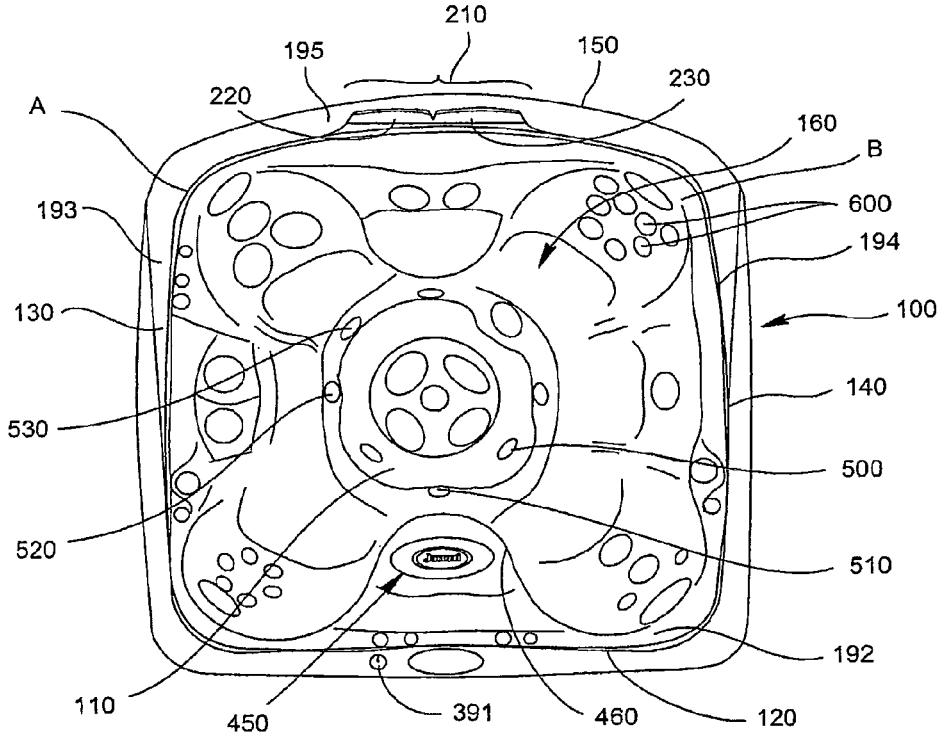
FIG. 2 is a more elevated, isometric view, in modified scale and rotated, of the spa of FIG. 1 and also illustrating an inventive illuminated indicia display apparatus also according to the principles of the invention.
Figure 3:
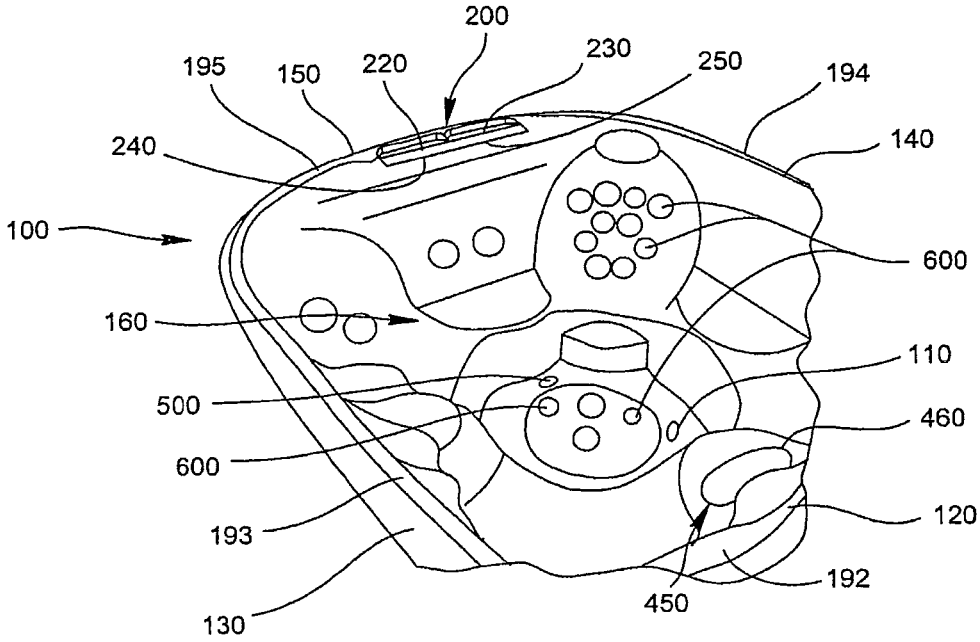
FIG. 3 is another elevated and side perspective view of the improved spa of FIGS. 1 and 2.
Figure 4:
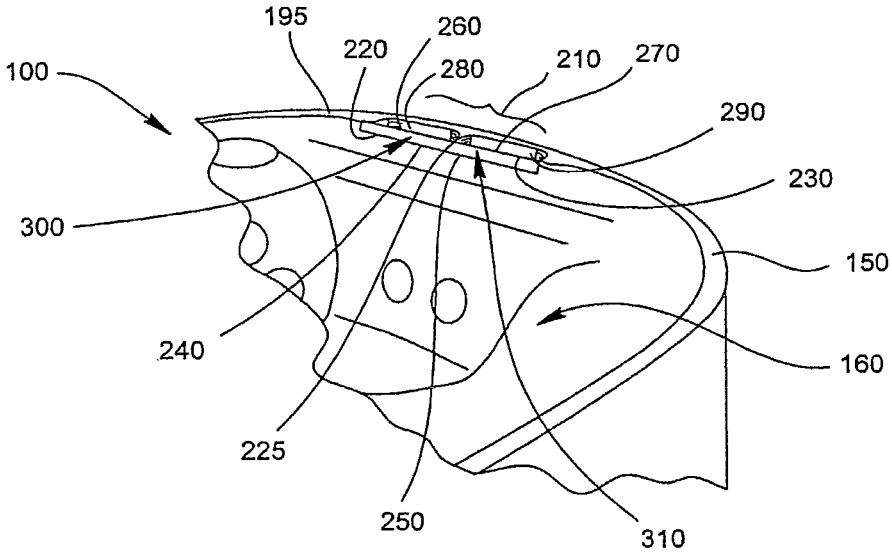
FIG. 4 is an enlarged perspective view of the inventive waterfall apparatus of the invention embodied in the illustrations of FIGS. 1-3.
Figure 5:
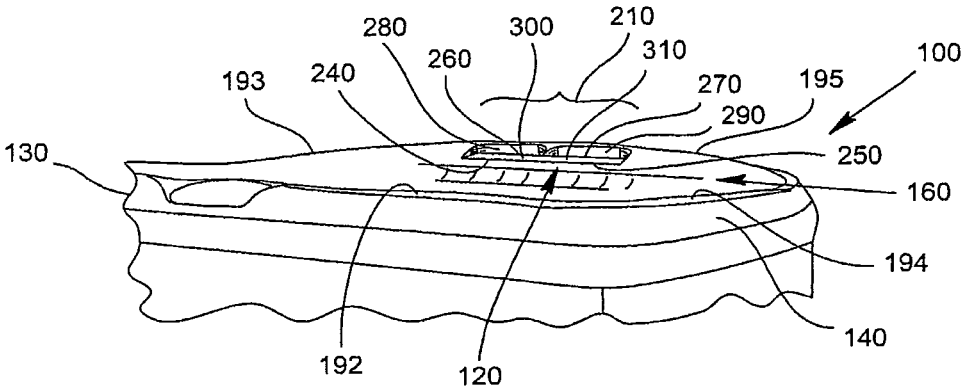
FIG. 5 is a front perspective view of the inventive waterfall apparatus of the invention embodied in the illustrations of FIGS. 1-4 and describing a raised portion of a side wall of the spa.
Figure 6:
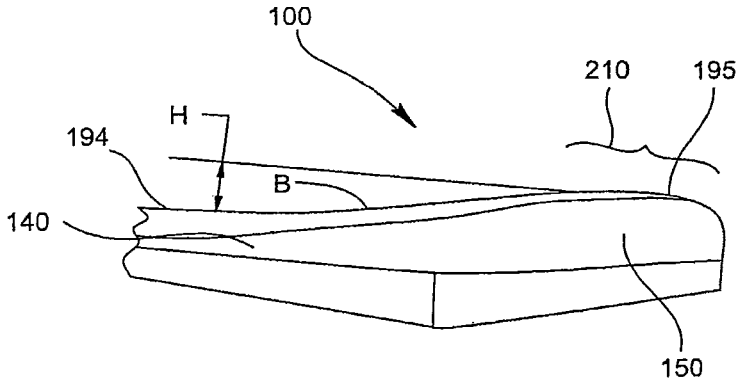
FIG. 6 is a rear perspective view of the inventive waterfall apparatus of FIG. 5 and also depicting, among other elements, the raised portion of the side wall of the spa.
Figure 17:
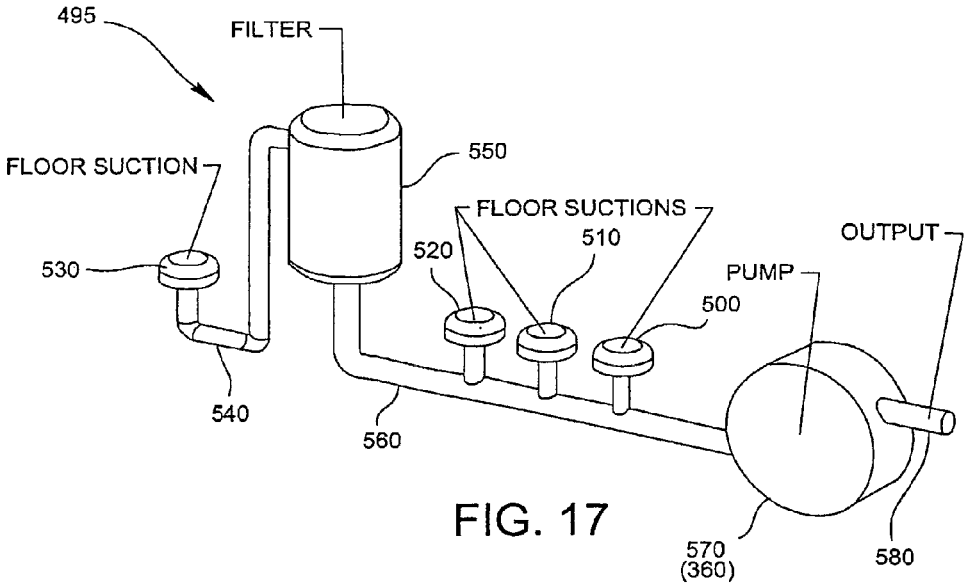
FIG. 17 is a schematic view of a spa filtration system.

Referring to FIGS. 2 and 17, the instant invention also includes a unique filtering system 495, which includes floor suction ports 500, 510, 520, and 530 in fluid communication with each other. Floor suction port 530 is provided in the foot-well of the spa 100, as also shown in FIGS. 2 and 17. The floor suction port 530 is fluidly coupled upstream to a conduit 540 that is fluidly coupled to a filter 550. The filter 550 can be a canister type filter containing a filter media. The canister can include a removable lid for periodic cleaning, and removal and replacement of the filter media. The canister is fluidly coupled upstream to a conduit 560 which is fluidly coupled to the floor suction ports 500, 510, and 520. The conduit 560 is fluidly coupled to the upstream end (i.e., vacuum side) of a primary pump 570 and exits pressurized fluid via the downstream end of the pump 570 through conduit 580 to spa jets 600 as shown in FIG. 1. Alternatively, the filtering system including suctions 500, 510, 520, 530, conduit 540, filter 550 and conduit 560 can form part of the fluid circuit 350 and positioned at aspiration conduit 370 upstream of the circulation pump 360.

Essentially, in operation, heavier particulate matter will settle to the spa floor and is less apt to be captured in the filtering cycle. To remove this debris, suction port 530 draws a portion of water from in the spa through the dedicated filter 550. This filter 550 is integrated with the plurality of suction ports 500, 510, and 520 and is dedicated to the spa's primary pump(s) 570 (or alternatively to circulation pump 360). The negative pressure from the pump(s) pulls debris from the spa foot-well through the floor-mounted suction port 530 into the filter 550.

Figure 16:
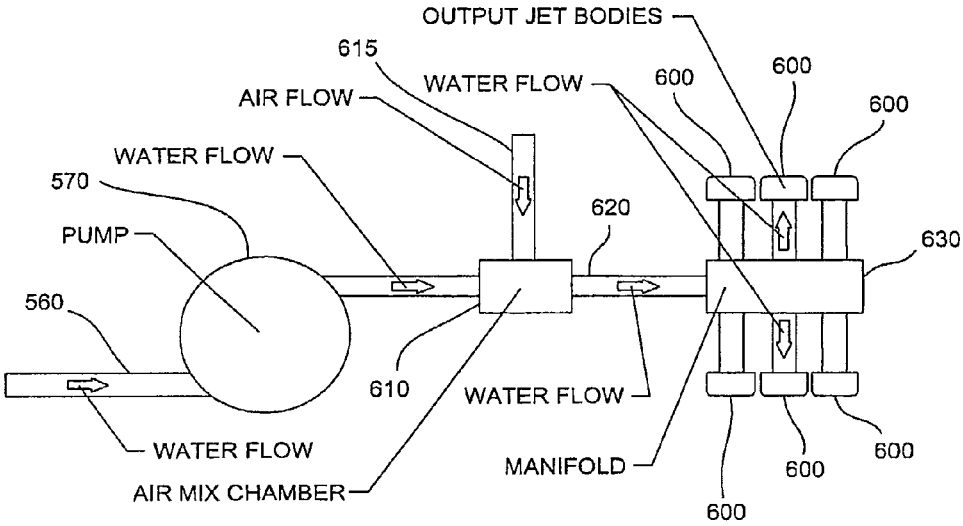
FIG. 16 is a schematic view of a mass aspiration system made in accordance with the instant invention.

FIG. 16 shows a unique mass aspiration system in accordance with the instant invention which is configured to pass aspirated water through jets 600, as also shown in FIGS. 1, 3, 7, and 11, among others. Specifically, once the water passes from conduit 560 through primary pump 570 and out conduit 580, the pressurized water passes through a venturi device 610, coupled to an air conduit 615, which is coupled to the atmosphere. The conduit 580 is fluidly coupled to an upstream end of the venturi tube 610, which is coupled to a conduit 620. The conduit 620 is fluidly coupled to a manifold 630.

The manifold 630 is fluidly coupled to one or more of a plurality of jets 600. In operation, pressurized water gasses through conduit 580. As the water then passes through the venturi tube 610, air is drawn into the venturi tube 610 via the air conduit 615 which has an upstream end open to the atmosphere. The air and water mixes in the venturi tube 610. This mixture then flows through conduit 620 and the aspirated water exits jets 600 into the spa.

The present arrangement induces air into the mass volume water line that feeds the jets 600. This arrangement provides a high air-to-water ratio and eliminates the need for individual air supply lines that are needed for nozzles in the prior art. Also, this arrangement of the mass air aspirator establishes a random and fluctuating ratio of gas-to-water mixture and thereby creates a unique sensation of the spa for the user.

Figure 18:
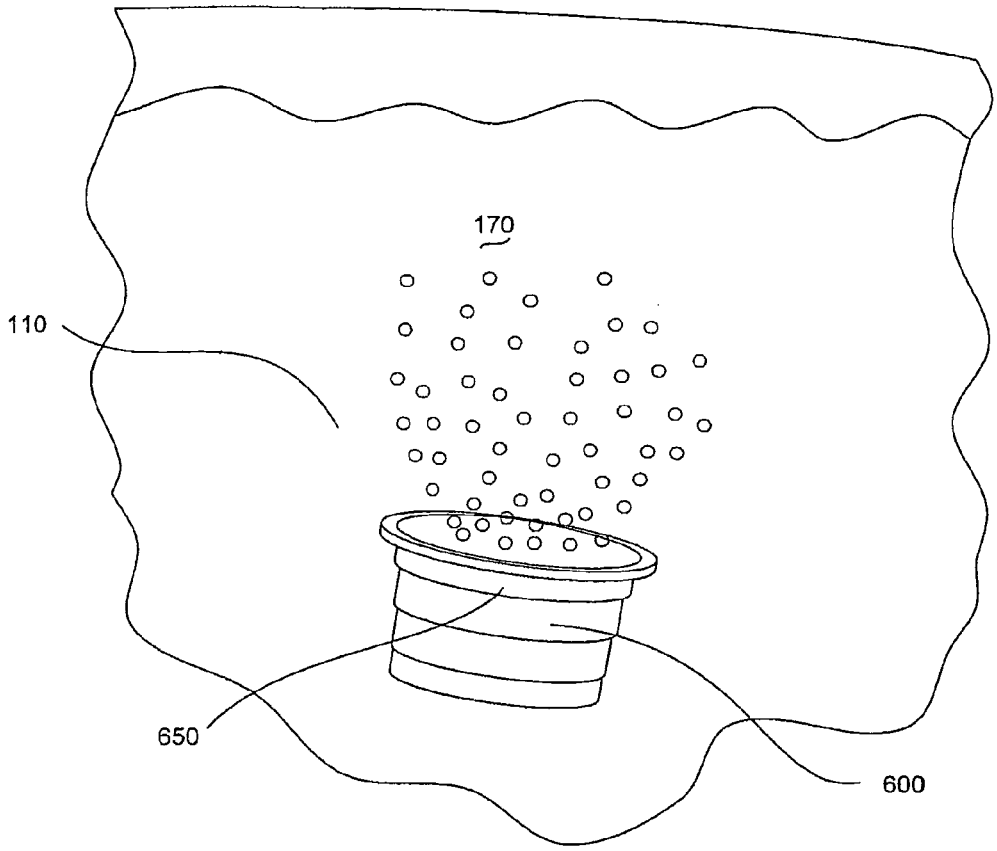
FIG. 18 is a perspective view of a jet lighting arrangement.

FIG. 18 shows one jet 600. The jet exit includes a transparent lens that is included on an inner structure, which permits water to pass therethrough. Adjacent and on an outer surface is provided a circuit board 650 having a plurality of LEDs. The LEDs can be one or more colors and can be controlled to emit light synchronized with all area lighting of the spa as well as water features, water fountains, foot-well illumination, and background lighting effects. The LEDs can also be embedded on a cylindrical circuit board surrounding the jet. Alternately, provided that the LEDs and the circuit board can be contained in a water-proof structure, this LED arrangement can be provided on an inner surface of the water jet body and exposed to water in the spa.

The spa 100 of the present invention further includes a suitable power supply (not shown) to provide power to activate each pump and the illuminated indicia display apparatus.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. Furthermore, it is to be understood that the present invention contemplates that, to the extent possible, one or more features of any embodiment can be combined with one or more features of any other embodiment.

The invention claimed is:

1. A method of circulating liquid in a vessel for forming a stream of liquid within the vessel, the method comprising the steps of:

a) providing a circulation pump in fluid communication with a body of liquid in the vessel;

b) delivering pressurized fluid from the circulation pump to an adjustable diverter valve that is in fluid communication with the circulation pump;

c) adjusting the diverter valve to change a rate of flow of liquid delivered to a supply conduit;

d) delivering liquid from the diverter valve through the supply conduit to at least one exit port; and e) providing a discharge line in fluid communication with the diverter valve and a discharge port positioned within the vessel;

wherein the discharge line diverts pressurized liquid from the circulation pump to the vessel via the discharge port when the diverter valve is adjusted to divert at least a portion of the liquid from the at least one exit port.

2. The method of claim 1, wherein the vessel is a spa, and the at least one exit port is a waterfall.

3. The method of claim 1, wherein the diverter valve comprises an actuator knob positioned on an upper edge of a wall of the vessel thereby allowing a user to adjust the rate of flow of liquid supplied to the at least one exit port.

4. A liquid circulation pump apparatus comprising:

a first conduit in fluid communication with a liquid containing area of a vessel;

a circulation pump in fluid communication with the first conduit, the first conduit positioned upstream of the circulation pump;

a supply conduit in fluid communication with the circulation pump, the supply conduit positioned downstream of the circulation pump;

a diverter valve positioned downstream of the circulation pump and upstream of the supply conduit and in fluid communication with the circulation pump and the supply conduit; and a discharge line positioned downstream of the circulation pump and connected with the diverter valve, the discharge line ending in a discharge port, wherein the circulation pump is adapted to pump liquid from the liquid containing area through the first conduit and delivers pressurized liquid through the supply conduit to the at least one exit port, and the diverter valve is adapted to change a rate of flow of liquid supplied to the at least one exit port and to divert pressurized liquid from the circulation pump to the vessel via the discharge port when the diverter valve is adjusted to divert at least a portion of the liquid from the at least one exit port.

* * * * *